United States Patent [19]

Verona et al.

[11] Patent Number: 4,922,550

[45] Date of Patent: May 8, 1990

[54] APACHE HELMET ADAPTER FOR NIGHT VISION GOGGLES

[75] Inventors: Robert W. Verona, Alexandria; J. Brian Gillespie, Fort Belvoir, both of Va.; James H. Brindle, Doylestown, Pa.

[73] Assignee: The United States of America as represented by the Secretary of the Army, Washington, D.C.

[21] Appl. No.: 265,447

[22] Filed: Nov. 1, 1988

[51] Int. Cl.[5] ..... A61F 9/00; A42B 3/02

[52] U.S. Cl. ..... 2/6; 2/424

[58] Field of Search ..... 2/6, 422, 423, 424

[56] References Cited

U.S. PATENT DOCUMENTS

| | | | |
|---|---|---|---|
| 2,813,271 | 11/1957 | Finken | 2/6 |
| 3,066,305 | 12/1962 | Aileo | 2/6 |
| 3,237,202 | 3/1966 | Aileo | 2/6 |
| 3,315,272 | 4/1967 | Olt et al. | 2/424 |

*Primary Examiner*—Wm. Carter Reynolds

*Attorney, Agent, or Firm*—Milton W. Lee; Max L. Harwell; Anthony T. Lane

[57] ABSTRACT

A pair of rail adapters which replace visor rails used on the U.S. Army Apache helmets, i.e. the AH-64 helmet. The rail adapters have a concave inner portion that is form fitted and attachable to the Apache helmet, with one rail adapter on each of the right and left upper front sides of the Apache helmet. The rail adapters have a convex outer portion that interface and is attachable with a visor guard Aviator's Night Vision Imaging System (ANVIS) goggle assembly and visor which are normally used with the U.S. Army ANVIS helmet, i.e. the SPH-4 helmet. Each of the rail adapters is made in one piece which has a thick upper portion with a half dovetailed open track in which the outer portion of the visor guard is attachable thereto. The rail adapters have a thin lower portion which provides clearance with the visor and the ANVIS goggle assembly when the visor and the assembly are in the line of sight position.

7 Claims, 3 Drawing Sheets

APACHE HELMET ADAPTER FOR NIGHT VISION GOGGLES

The invention described herein may be manufactured, used, and licensed by the U.S. Government for governmental purposes without the payment of any royalties thereon.

BACKGROUND OF INVENTION

The present invention is in the field of aviator helmet mountable displays and especially to providing an interface rail adapter device for mounting a standard imaging system and visor associated therewith on a helmet upon which either are normally mountable. More specifically, a need exists for attaching a standard visor guard, upon which an Aviator's Night Vision Imaging System (ANVIS) goggle assembly and standard visor are connectable thereto, on the more advanced U.S. Army AH-64 helmet, i.e. the Apache helmet. The Apache uses a helment which has avionics built in and a display attached thereto. The display is known as the integrated helmet and display sight system (IHADSS). The helment without the display is the integrated helmet unit (IHU). The ANVIS mount and visor guard with visor were designed to fit the standard visor guard with visor on an SPH-4 aviator helmet, and this particular visor mount is not compatible with the IHU Apache helmet. In fact, modifications of either or both the ANVIS visor mount and/or the Apache helmet would be required for the ANVIS mount and visor guard with visor to be mounted on the Apache helmet.

The AH-64 Apache helmet visor guard is somewhat different from the SPH-4 model and has a visor mount that is quite different from the ANVIS mount and visor guard. Thus, the ANVIS mount and visor guard are not compatible with the standard AH-64 Apache helmet.

SUMMARY OF THE INVENTION

The present invention is comprised of two specifically designed interface rail adapters attachable to existing mounting points on the Apache helmet. These rail adapters, which replace the old Apache visor rails, are comprised of one rail on each of the right and left upper front sides of the helmet. The ANVIS mount and visor guard with visor may now be mountable on the rail adapters. The ANVIS goggles may be mounted on the ANVIS mount and visor guard allowing the Apache pilot to wear the ANVIS goggles on the visor or to use the sighting system already built in the IHU Apache helmet.

The interface rail adapters may be moulded from plastic to the proper size to be attachable to the Apache helmet and to support the visor guard structure and ANVIS mount assembly. The rail adapters are comprised of an open track which the outer edges of the visor may be flexed into since the visor is made of thin flexible transparent plastic and can slide therethrough as needed. Both side walls of the open track may be at a right angle to the bottom of the track. However, the wall closest to the helmet, herein called the inner wall of the open track, may be beveled inward toward the bottom of the open track. The outer edges of the visor preferably has a strip of the same type plastic as the rail adapters are made of added thereto so that when the visor is flexed outward to fit inside the tracks, the strip of the visor is friction tight against the walls of the tracks and can only be moved by an aviator manipulating the visor. The visor has an extension arm which when mounted on the visor guard is positioned immediately under an elongated visor slot in the upper front of the visor guard structure. A knob is threadably connected to the end of the extension arm through the slot and is positioned on the outer front part of the visor guard. The knob is slidable along the slot to move the visor up in the stow position or down in the line of sight of the aviator.

DETAILED DESCRIPTION OF THE PREFERRED EMBODIMENT

Figure 1:
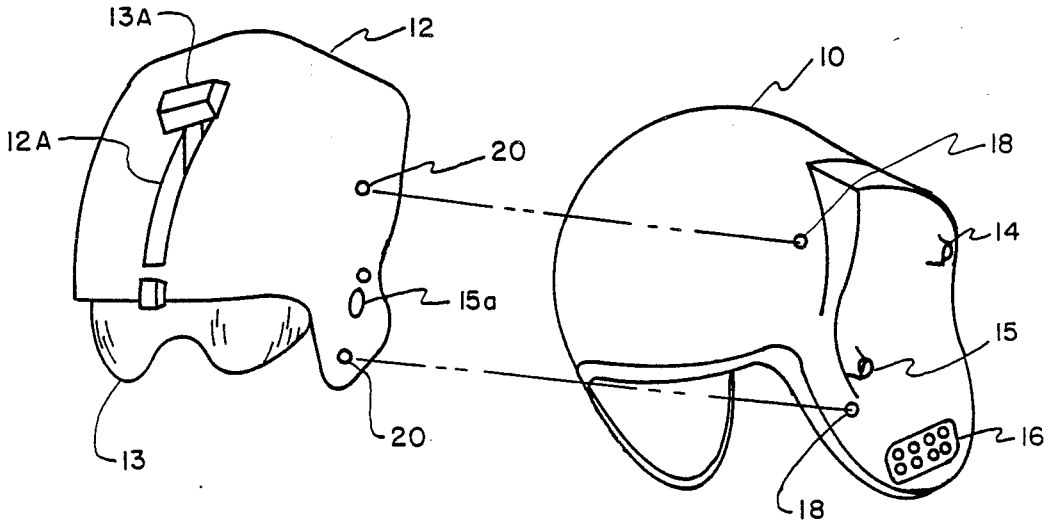
FIG. 1 PRIOR ART
FIG. 1 is a perspective view of the Apache helmet illustrating the prior art helmet visor assembly in an exploded view.

FIG. 1 is a perspective view of the U.S. Army Apache style aviators helmet 10 with an existing visor assembly 12 shown in exploded view which is attachable thereto. The Apache helmet was originally made for the AH-64 Apache helicopter. The Apache helmet has built therein portions of the integrated helmet and display sight system (IHADSS). The IHADSS has among other features two pilot's head position sensors on each side of helmet 10. These sensors are identified by numbers 14 and 15. Assembly 12 has an opening 15*a* therein through which sensor 15 extends when 12 is attached to 10 by screws 20 on 12 being threadably attached to threaded visor attachment points 18 on 10. When assembly 12 is attached to 10 the visor 13, which has a slide control mechanism extending to a knob 13*a* out slot 12*a*, and assembly 12 are positioned outward from the face of the pilot enough to provide room under the visor 13 for imagers which are mounted on the side of the helmet 10 and extend to the line of sight of the pilot. FIG. 1 has been discussed to emphasize that visor assembly 12 will not support both a visor and a forehead mounted binocular goggle assembly, such as the ANVIS goggle system.

Figure 2:
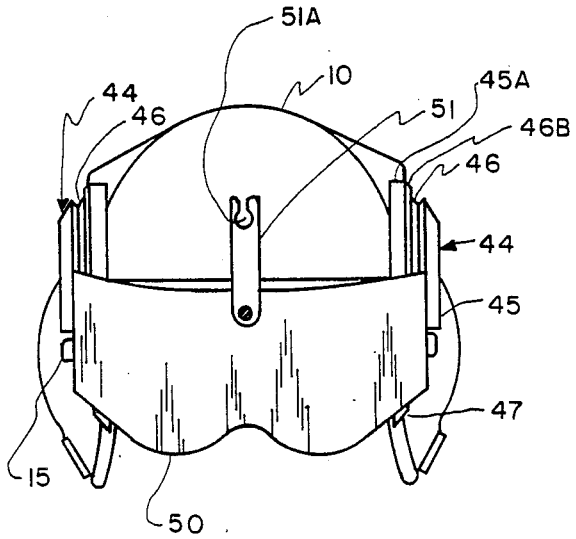
FIGS. 2 and 3 illustrate a front view and side view respectively of the Apache helmet with the inventive rail adapters attached thereto and the visor mounted on said rail adapters.
Figure 3:
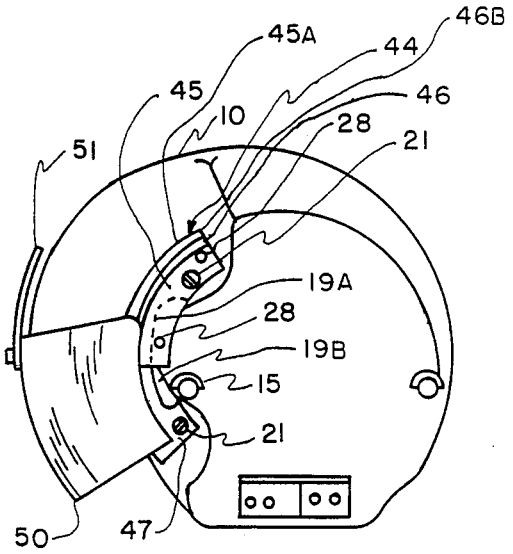

Refer now to FIGS. 2, 3, 4, 5A, 5B and 6 for an explanation of the present inventive rail adapters which make it possible to mount the U.S. Army standard visor guard and ANVIS mount assembly and visor on the Apache helmet by providing an interface between these previously incompatible items. FIGS. 2 and 3 illustrate juxtaposed front and side views of the Apache helmet with the inventive rail adapters 44 attached thereto on the left and right upper front sides. The attachment of 44 to 10 is made by a rail adapter attachment means, such as by attachment screws 21 on the upper thick portion 45 and the lower thin portion 47 of 44 which are screw threadable into existing attachment points 18 on 10. Since portion 45 is thick, a recess 21A is included so that the upper screw 21, which is the same size as the lower screw 21, will handily attach to point 18. The standard visor 50 is shown in FIGS. 2 and 3 to better clarify how 50 is slidably mountable on an open track 46 and to illustrate the visor extension arm 51 which has a winged knob 52 screw threadably attachable to the open threaded portion 51A.

Figure 5B:
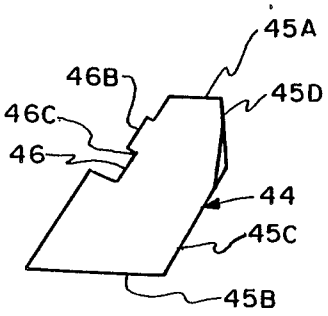
FIGS. 5A and 5B are sectional end views 5—5 of FIG. 4 of the upper thick portion of the rail adapter showing respectively the beveled and right angled inner walls of the open track.
Figure 5A:
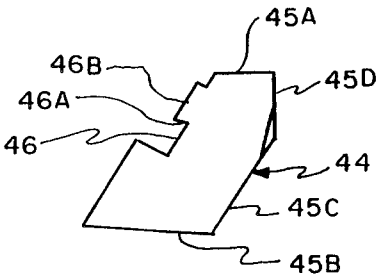
Figure 4:
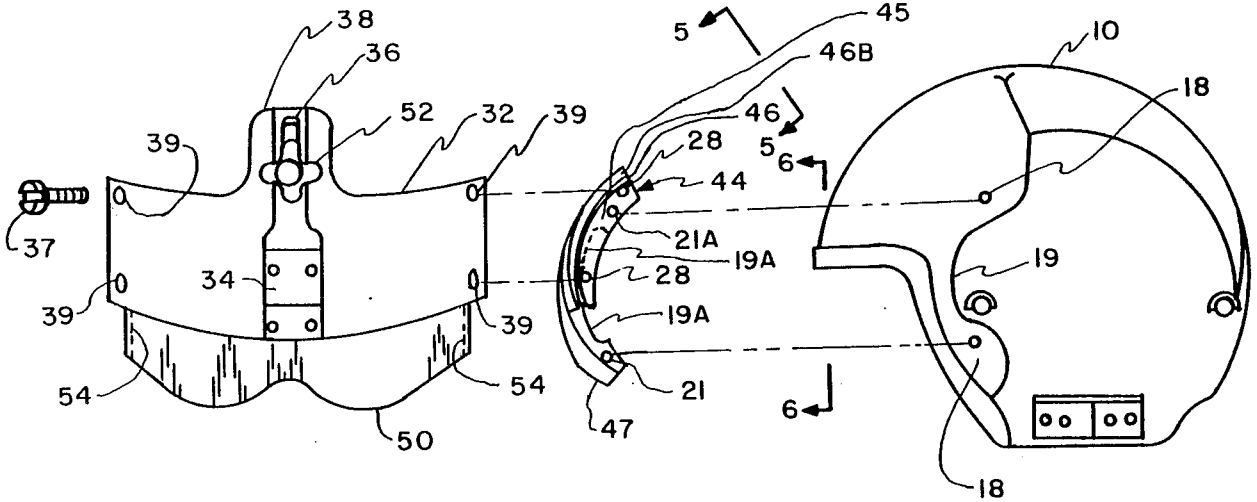
FIG. 4 is a perspective exploded view of the Apache helmet with the inventive rail adapter and the visor guard and visor as attachable to the rail adapter.
Figure 6:
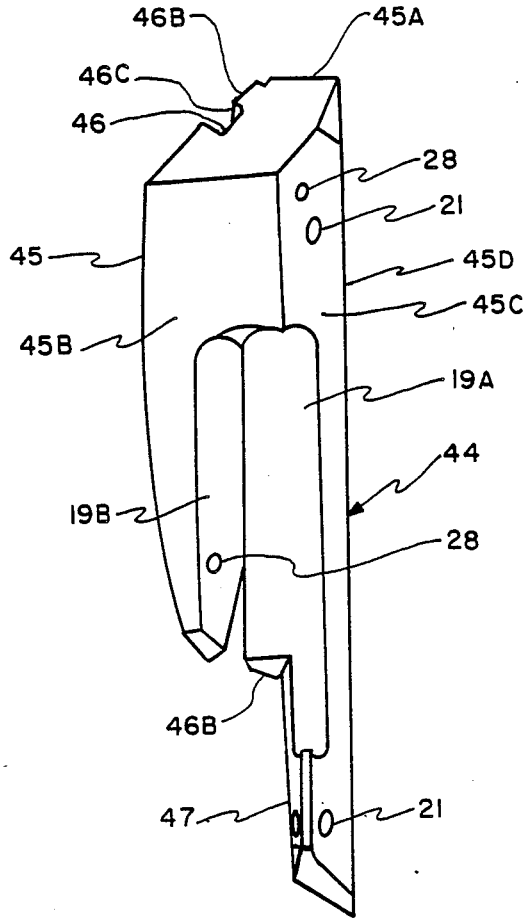
FIG. 6 is a sectional view 6—6 of FIG. 4 illustrating the concave inner area of the rail adapter.

The exploded view as shown by FIG. 4 and the sectional views of FIGS. 5A, 5B and 6 should now be referred to to understand how the rail adapters provide the mounting means for the standard visor guard 32 and visor 50 on the Apache helmet 10. Please note that 10 and 44 are side views and 32 is front view. The visor 50 is attached to 32 by knob 52 and a shaft extending therefrom screw threaded to 51A through an elongated visor slot 36. Slot 36 is large enough that the shaft of 52 can easily move there through but the knob will tighten down on the shoulders of 36 when screw threaded into 51A. Slot 36 runs out an extension 38 of 32 so that 50 can be moved up to the stow position under 32. Visor 50 has layered along the facial side of both outer edges thereof a strip of plastic 54, which are preferably beveled to fit exactly with inner wall 46A, which slides along track 46. Strips 54 ride on the inner walls 46A or 46C, due to which type inner wall is used. FIGS. 5A and 5B illustrate more specifically the beveled inner walls 46A and the right angled inner wall 46C respectively of open track 46 which are formed on the side of ridge 46B. The rail adapters 44 may be made of one solid piece, preferably of plastic. Visor guard 32 is attached to rail adapters 44 by a visor guard attachment means, such as by screws 37 threaded to attachment points 28 on 44 through smooth or screw threaded holes 39 on 32. Points 28 may be made of brass which is embedded in 44.

Refer to sectional views of FIGS. 5A, 5B, and 6 for a more specific illustration of the rail adapters, wherein like reference numbers apply in the other Figures. Only the left side rail adapter is shown in detail. However, the right side adapter is an opposite projection of the left side adapter. FIG. 6 better illustrates the adapter concave inner area, comprised of 45B of portion 45, the cutout 19A which extends from 45 into the lower thin portion 47, and the remainder of 47. Surface 45D is flat all around 44, i.e. forms a flat surface on both 45 and 47, and is used as a starting surface for explaining 44 in FIG. 6. Surface 45C is adjacent to and slanted away from surface 45D and is also concave to conform to the shape of helmet 10. Surface 45B is adjacent to and slanted away from surface 45C and is concave for the same reason as surface 45C. A cutout, having generally perpendicular surfaces 19A from 45 and 47 and 19B from 45, is made to clear the raised portion 19 on helmet 10. The rail adapters 44 also have a convex outer area around 45 and 47. The convex outer area around 45 has a visor guard attachment means thereon comprised of screw threadable attachment points 28. The outer area of 45 is now explained with reference to FIGS. 5A, 5B, and 2. First, starting at the outermost surface 45A of 44 and proceed down the side of 44, as mounted on helmet 10, is ridge 46B and the inner wall which may be either 46A or 46C, and the open track 46. The lower thin portion 47 provides clearance for visor 50 when 50 is in the lowered, i.e. line of sight, position as shown in FIGS. 2, 3, and 4.

Visor guard 32 also has the feature of an ANVIS mount pad 34 for mounting the ANVIS goggle system (not shown) thereon. The ANVIS goggle system and visor 50 can both be in the line of sight of the aviator interchangeably. This capability is made possible by the inventive rail adapters 44. The rail adapters 44 have therefore made it possible to attach the previously nonattachable standard visor guard and ANVIS mounting assembly and visor to the IHADSS Apache helmet.

We claim:

1. A rail adapter device for attachably interfacing on an aviators helmet previously incompatible visor guard having Aviators Night Vision Imaging System (ANVIS) mount assembly attachable thereto and a visor which is slidably connectable thereto wherein said visor is further slidably interfaced with said rail adapter device, said device comprised of:

at least two single piece rail adapters with one rail adapter attachable to existing mounting points on each of the right and the left front sides of said aviators helmet, each rail adapter is shaped with a concave inner area to conform to the respective outer left and right upper front shapes of said helmet and a convex outer area wherein each rail adapter has an upper thick portion onto which said visor guard is attachable and an open track on said outer area through which the outer edges of said visor are slidably mounted and a lower thin portion which provides clearance for said visor when said visor is extended to its lower position in the line of sight of the aviator with said visor between said ANVIS mount assembly and goggle system and said rail adapter.

2. A rail adapter device for use on an integrated helmet and display sight system (IHADSS) aviators helmet for interfacing said aviators helmet with a visor guard upon which an Aviators Night Vision Imaging System (ANVIS) mount assembly is attachable and a visor is slidably attached on the center front thereof wherein said visor is further slidably interfaced with said rail adapter device, said device comprising:

at least two single piece rail adapters with one rail adapter attachable to each of the left and right upper front areas of said aviators helmet by rail adapter attachment means, each of said single piece rail adapters is shaped with a concave inner area to conform to the respective outer left and right upper front areas of said aviators helmet and a convex outer area shaped to interface with said visor guard and visor, said rail adapters further comprised of a thin lower portion and an upper thick portion to which said visor guard is attachable by visor guard attachment means and to which the outer edges of said visor is slidably mountable to an open track on the outer area thereof and said visor has an extension that is positioned along the elongated visor slot on the upper front of said visor guard and a knob screw threadable onto the end of said extension arm that extends to the outside of the slot so that the aviator may slidably move the visor down in front of the aviators eyes or up in the stow position by manipulating said knob.

3. A rail adapter device as set forth in claim 2 wherein said rail adapters attachment means is by screw threadably attaching said rail adapter to said helmet at connecting points on said upper thick portion and said lower thin portion.

4. A rail adapter device as set forth in claim 3 wherein said visor guard attachment means is by screw threadably attaching said visor guard to at least two connecting points on said upper thick portion of said rail adapter.

5. A rail adapter device as set forth in claim 3 wherein each of said single piece rail adapters are made of plastic.

6. A rail adapter device as set forth in claim 1 wherein said open track is further comprised of an inner wall which is beveled inward toward the bottom of said open track.

7. A rail adapter device as set forth in claim 2 wherein said open track is a half dovetailed open track.

* * * * *